US009976254B2

(12) United States Patent
Alias et al.

(10) Patent No.: US 9,976,254 B2
(45) Date of Patent: May 22, 2018

(54) PAPERMAKING FABRIC WITH DOUBLE LOOP SEAM

(71) Applicant: VOITH PATENT GMBH, Heidenheim (DE)

(72) Inventors: Anas Alias, Perak Darul Ridzuan (MY); Juergen Abraham, Nattheim (DE)

(73) Assignee: Voith Patent GmbH, Heidenheim (DE)

( * ) Notice: Subject to any disclaimer, the term of this patent is extended or adjusted under 35 U.S.C. 154(b) by 147 days.

(21) Appl. No.: 14/951,575

(22) Filed: Nov. 25, 2015

(65) Prior Publication Data

US 2016/0145799 A1 May 26, 2016

(30) Foreign Application Priority Data

Nov. 25, 2014 (DE) ..... 10 2014 223 972

(51) Int. Cl.

| | |
|---|---|
| ***D21F 7/10*** | (2006.01) |
| ***D21F 7/12*** | (2006.01) |
| ***D03D 3/04*** | (2006.01) |
| ***D21F 1/00*** | (2006.01) |

(52) U.S. Cl.

CPC ..... *D21F 7/10* (2013.01); *D03D 3/04* (2013.01); *D21F 1/0054* (2013.01); *D21F 7/12* (2013.01)

(58) Field of Classification Search

CPC . D21F 7/10; D21F 1/12; D21F 1/0054; D21F 1/10; D21F 1/14; D21F 1/16; D21F 7/08; D21F 7/12; D03D 3/04; D03D 11/02

USPC ..... 162/348, 904; 139/383 AA

See application file for complete search history.

(56) References Cited

U.S. PATENT DOCUMENTS 4,095,622 A * 6/1978 MacBean ..... D21F 1/0054 139/383 AA
4,438,789 A * 3/1984 MacBean ..... D03D 3/04 139/383 AA
5,458,161 A * 10/1995 Scarfe ..... D03D 3/04 139/383 AA
5,776,313 A * 7/1998 Bakis ..... D03D 15/00 162/358.2
6,332,480 B1 12/2001 Best (Continued)

FOREIGN PATENT DOCUMENTS

EP 1054097 A1 11/2000

*Primary Examiner* — Eric Hug

(74) *Attorney, Agent, or Firm* — Laurence A. Greenberg; Werner H. Stemer; Ralph E. Locher

(57) ABSTRACT

A seam for joining together the ends of woven fabric to form an endless belt is particularly suitable for joining the ends of woven synthetic dryer fabrics as used in the dryer section of paper making machines and is particularly applicable to joining the ends of those dryer fabrics in at least the machine direction of the fabric. A papermaking fabric comprising a woven fabric body having opposing ends, said fabric body having a system of MD-yarns interwoven with a system of CD yarns. The MD-yarns include first pairs of MD-yarns, second pairs of MD-yarns and third pairs of MD-yarns and the first and the second pairs of MD-yarns form two seam loops, while the third MD-yarns forms the binder. The loops are at identical length to each other over the whole fabric width. Such seam construction reduces marking and increases the seam strength and seam abrasion resistance.

21 Claims, 2 Drawing Sheets

(56) References Cited

U.S. PATENT DOCUMENTS

2014/0231039 A1* 8/2014 Patel ..... D21F 1/0027
162/289

* cited by examiner

PAPERMAKING FABRIC WITH DOUBLE LOOP SEAM

CROSS-REFERENCE TO RELATED APPLICATION

This application claims the priority, under 35 U.S.C. § 119, of German application DE 10 2014 223 972.9, filed Nov. 25, 2014; the prior application is herewith incorporated by reference in its entirety.

BACKGROUND OF THE INVENTION

Field of the Invention

This invention relates to a seam for joining together the ends of woven fabric to form an endless belt. It is applicable more specifically to joining the ends of woven synthetic dryer fabrics as used in the dryer section of paper making machines and is particularly applicable to joining the ends of those dryer fabrics in at least the machine direction of the fabric.

Description of Prior Art

Industrial papermaking fabrics can be made flat and joined endless either during their manufacture or in the web processing and/or forming machine. In the later case they are called on-machine seamable fabrics. As an example, seam loops are formed at each of the transverse end of the papermaking fabric. To make the industrial papermaking fabric endless when drawn into the machine, the two transversal edge sections are brought together and the seam loops at the different transversal edge sections are interdigitated to form a common channel through which a seam pintle is pulled for joining the two transversal edge sections. In many cases each of the seam loops is formed at the respective transversal edge section of the fabric, by weaving of an MD-yarn with the CD-yarns, passing beyond the CD-yarn which is closest to the transversal edge section, by forming a loop and by weaving the MD-yarn back into the fabrics.

It is common practice to weave the dryer fabric as a long wide flat single piece and then join the ends on the machine to make an endless belt. There are several known methods of making the joint, or seam, as it is called. In one method, each end of the fabric is provided with a set of metal clipper type loops. In another method, metal or plastic loops are sewn into the ends which have been reinforced to prevent unraveling. In still another method, cross machine strands (weft) are removed near the ends of the fabric and the ends are folded back in such a way that MD-loops in the unwefted sections project. In each case the joint is completed when the array of loops at one end is intermeshed with the array of loops at the other end and brought into register to form a tubular passage through which a hinge pin or pintle wire is inserted.

The seam area is the weakest part of the fabric, because the tensile strength of the seam is significantly lower than the tensile strength of the body of the fabric. Further on, the seam area tends to cause hydraulic and/or topographic marking of the fibrous web formed and/or processed thereon due to the different structure of the seam area in regard to the body of the fabric.

In the past many attempts have been made to improve the tensile strength of the seam on the one hand and to reduce the marking of the seam on the other hand.

U.S. Pat. No. 6,332,480 B1 and its counterpart European published patent application EP 1 054 097 A1, for example, describe a seam construction where the MD-yarn forming a seam loop weaves back into the weave path of the adjacent MD-yarn. The seam construction of that solution exhibits several disadvantages caused by an extreme bending of the MD-yarns when forming the loops when weaving back into the weave path of the adjacent MD-yarn. The extreme bending of the MD-yarns forming the loops impacts an increased strain into these MD-yarns causing the loops one hand tend to tilt in an upright position out of the planes of the web and machine sides of the fabric and on the other hand to increase the spacing between the loops which are arranged along the transverse ends of the fabric. Such a tilting of the loops as well as the increase in spacing between the loops causes an increase in topographical marking. The increase in spacing between the loops further increases air permeability in the seam area in relation to the body of the fabric. This causes an increase in hydraulic marking. Due to increased strain such a seam construction further shows relatively weak tensile strength, because the back woven part of the MD-yarns can be pulled out relatively easily.

U.S. Pat. No. 4,095,622 describes a woven fabric and a method of forming a seam therein comprising a woven fabric as used for supporting a paper web on a paper making machine.

SUMMARY OF INVENTION

It is accordingly an object of the invention to provide a papermaking fabric with a seam construction which overcomes the above-mentioned and other disadvantages of the heretofore-known devices and methods of this general type and which seam construction has reduced marking yet increased seam strength due to the increased number of seam loops available compared to conventional seams and also increased seam abrasion resistance due to the higher number of seam loops, with more material available of the seam loop.

With the foregoing and other objects in view there is provided, in accordance with the invention, a papermaking fabric, comprising:

- a woven fabric body having opposing ends defining widthwise edges;
- the fabric body having a system of MD-yarns interwoven with a system of CD yarns in a single layer weave construction;
- the MD-yarns including first pairs of MD-yarns, second pairs of MD-yarns, and third pairs of MD-yarns;
- the first pairs, second pairs, and third pairs of MD-yarns being interwoven with the CD yarns in a repeat weave pattern; and
- each of the first and second pairs of MD-yarns forming seaming loops at at least one of the widthwise edges of the fabric.

In other words, the objects of the invention are solved by an industrial papermaking fabric for a fibrous web forming and/or processing machine, which has a web contacting side and a machine contacting side and which has two transversal ends which determine the length of the fabric and which are spaced apart in longitudinal direction. To make the papermaking fabric endless the two transversal end sections can be joined together. The papermaking fabric comprises or consists of a fabric made from MD-yarns interwoven with CD-yarns, wherein the fabric preferably has a single layer weave construction. The said MD-yarns comprising first pairs of MD-yarns, second pairs of MD-yarns and third pairs of MD-yarns. Further the said first pairs, second pairs and third pairs of MD-yarns are interwoven with said CD yarns in a repeat weave pattern. The industrial papermaking fabric of the present invention is characterized in, that each of said first and second of MD-yarns form seaming loops at widthwise edges of said fabric. Preferably the said first pairs, second pairs and third pairs MD-yarns are arranged in a sequence, such that the said second pairs of MD-yarns are adjacent to the said first pairs of MD-yarns, and the said third pairs of MD-yarns are adjacent to the said second pairs of MD-yarns.

By providing an industrial papermaking fabric with the features according to claim 1 of the present invention, a papermaking fabric with enhanced seam strength is provided, preferably the first pairs of MD-yarns including first MD-yarns folded back and second MD-yarns in alignment and substantial abutment with said first MD-yarns to form a first group of loops; the second pairs of MD-yarns including third MD-yarns that are folded back, and fourth MD-yarns in alignment and substantial abutment with said third MD-yarns to form a second group of loops; the third pairs of MD-yarns including fifth MD-yarns folded back and sixth MD-yarns in alignment and substantial abutment with said fifth MD-yarns; holding the last CD-yarns forming the end of the fabric.

The term "body of the fabric" is defined by the biggest uniform area of the woven structure. The body of the fabric for example does not include the seam area of the fabric at the transversal end sections and can exclude the sections along the longitudinal edges of the fabric. The word "a MD-yarn forms a loop and weaves back into the weave path of another MD-yarn" means that a considered MD-yarn first weaves with several CD-yarns at a transversal edge section, when returning into the fabric after forming a loop. In this case the weaving of the MD-yarn with some of the CD-yarns after forming the loop takes place at a location which should be occupied by the other MD-yarn. This means that the MD-yarn weaves with some of the CD-yarns instead of the other MD-yarn. After a weaving for a certain distance with the CD-yarns when returning back into the fabric the weaving of the MD-yarn with CD-yarns stops and the other MD-yarn takes over in weaving with the remaining CD-yarns.

The MD-yarns and/or the CD-yarns preferable are monofilaments. The monofilaments can be from PET, PPS, PCTA. It is also possible that a first portion of the MD-yarns and/or the CD-yarns are monofilaments from PET and a second portion of the MD-yarns are monofilaments from PPS. Preferably from between 30% to 70% of the MD-yarns and/or the CD-yarns are monofilaments from PET and from 70% to 30% of the MD-yarns and/or the CD-yarns are monofilaments from PPS.

Alternatively a first portion of the MD-yarns and/or the CD-yarns are monofilaments from PPS and a second portion of the MD-yarns are monofilaments from PCTA. Preferably from between 30% to 70% of the MD-yarns and/or the CD-yarns are monofilaments from PPS and from 70% to 30% of the MD-yarns and/or the CD-yarns are monofilaments from PCTA.

Preferably the fabric is flat woven. The fabric can be a single layer fabric, to provide an easy to clean and easy to manufacture construction. The body of the fabric can have an air permeability of less than 135 cfm, preferably of between 130 cfm to 55 cfm.

At least some of the MD-yarns can have a rectangular cross section. The size range of the said rectangular MD-yarns can be 0.25 mm×0.55 mm to 0.45 mm×0.75 mm, preferably 0.36×0.67 mm. At least some of the MD-yarns can have a round cross section. The dimension of the said round MD-yarns is 0.50 mm to 0.70 mm, preferably 0.60 mm.

By providing an industrial papermaking fabric with the features as claimed, a first pairs of MD-yarns including first MD-yarns folded back and second MD-yarns in alignment and substantial abutment with said first MD-yarns to form a first group of loops; second pairs of MD-yarns including third MD-yarns that are folded back, and fourth MD-yarns in alignment and substantial abutment with said third MD-yarns to form a second group of loops. The said loops are at identical length to each other over the whole fabric width.

A so-called "seam loop" is formed by one of the MD-yarns of a pair of MD-yarns which is looped and woven back into the fabric over a short distance and reaches the end of the another MD-yarn of the pair of MD-yarns. The woven back MD-yarn of the pair thereby continues the weave path of the other MD-yarn of the pair.

By providing an industrial papermaking fabric with the features as described, first MD-yarn of the first pairs of MD-yarns looped and woven back into the fabric over a short distance and attached to the end of the second MD-yarn of the first pairs of MD-yarns. Third MD-yarn of the second pairs of MD-yarns looped and woven back into the fabric over a short distance and attached to the end of the fourth MD-yarn of the second pairs of MD-yarns. Fifth MD-yarn of the third pairs of MD-yarns looped and woven back into the fabric over a short distance and attached to the end of the sixth MD-yarn of the third pairs MD-yarns.

The industrial fabric preferably is a dryer fabric for use in a papermaking machine or a conveyor fabric for use in a spun-bond web or melt-blown web making machine.

Another aspect of the present invention is that a papermaking fabric comprising a woven fabric body having opposing ends, said fabric body having a system of MD-yarns interwoven with a system of CD yarns; the fabric has a single layer weave construction; the percentage of MD-yarns ends which are formed as the seam loop is 33.3%.

The percentage of MD-yarns ends which are formed as the seam loop is calculated as 2/6*100=33.3%. An increase of 8.3% material for the seam loop compared to normal seam design. As the material of the seam loop is increased the seam strength and abrasion resistance would be also increased. The improved properties would be able to increase the life of the fabric seam in the paper machine.

Other features which are considered as characteristic for the invention are set forth in the appended claims.

Although the invention is illustrated and described herein as embodied in a double loop seam in fabric, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF PREFERRED EMBODIMENTS

Figure 1:
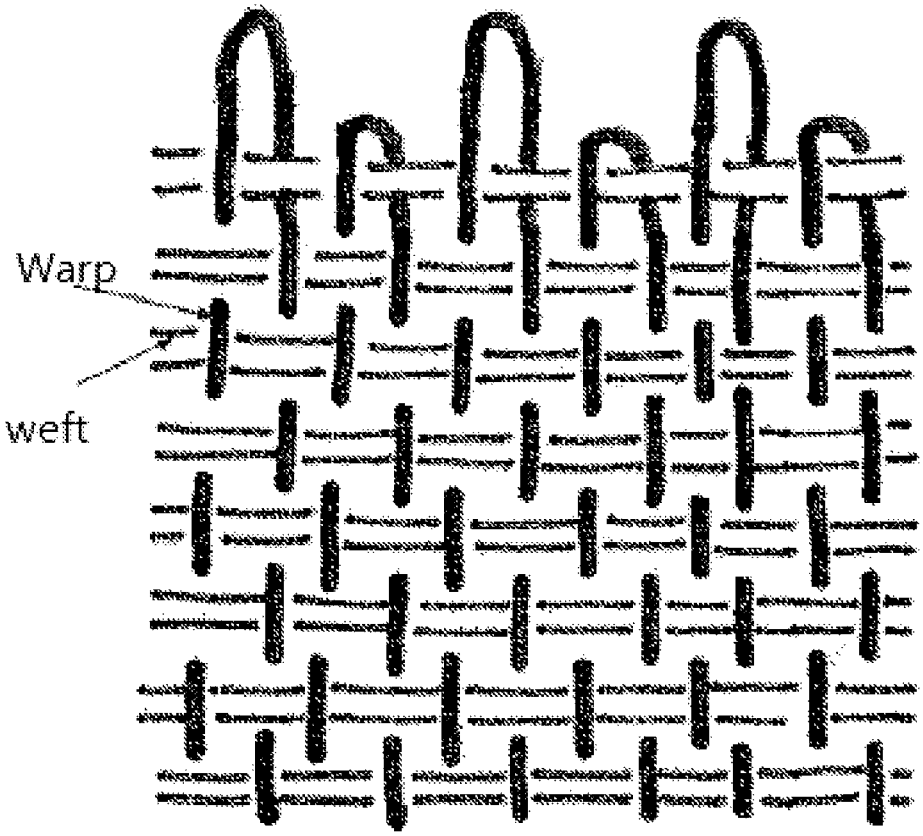
FIG. 1 is a partial plan view of a fabric with a normal single loop seam.

Referring now to the figures of the drawing in detail and first, particularly, to FIG. 1 thereof, there is shown a partial plan view of a fabric with a normal single loop seam. The papermaking fabric comprises a woven fabric body having opposing ends. The fabric body has a system of MD-yarns interwoven with a system of CD yarns. The fabric has a single layer weave construction. The MD-yarns comprise first pairs of MD-yarns and second pairs of MD-yarns. The first pairs of MD-yarns including first MD-yarns folded back and second MD-yarns in alignment and substantial abutment with said first MD-yarns to form first loops. Such existing small loop seams (loop made from the warp yarn) contain only one seam loop and one binder. There is only one loop used as the fabric end connector of every four ends. The seam strength and abrasion resistance are limited. Such design contains four ends per repeat of its weave pattern. Two MD-yarn ends are used to form a loop and the other two are for the binder. The MD-yarn ends used for the seam loops is 25%.

Figure 2:
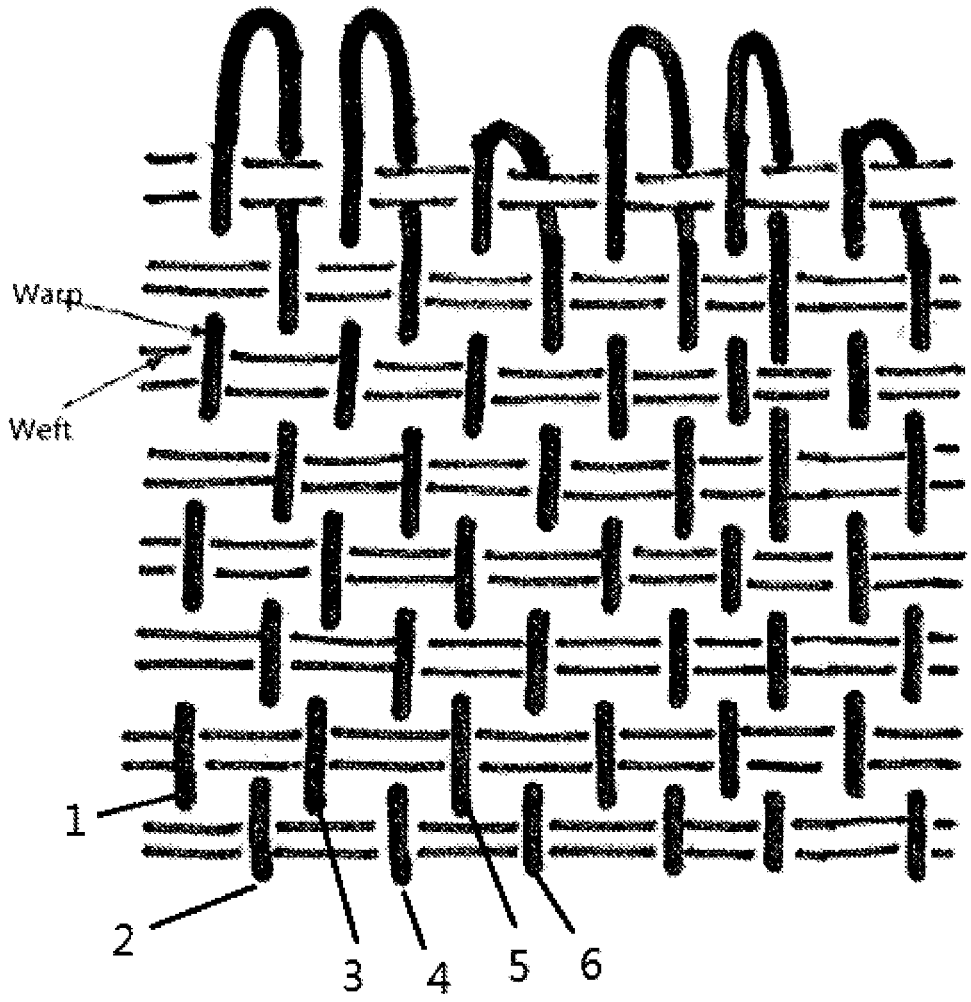
FIG. 2 is a partial plan view of a fabric with a double loop seam

FIG. 2 shows a partial plan view of a fabric with a double loop seam according to an embodiment of the present invention. The papermaking fabric comprises a woven fabric body having opposing ends. The fabric body has a system of MD-yarns interwoven with a system of CD yarns. The fabric has a single layer weave construction. The MD-yarns include first pairs of MD-yarns, second pairs of MD-yarns and third pairs of MD-yarns. The first pairs, second pairs and third pairs MD-yarns are interwoven with the CD yarns in a repeat weave pattern. Each of the first and second pairs form seaming loops at widthwise edges of the fabric. The first pairs, second pairs and third pairs MD-yarns are arranged in the sequence, the said second pairs of MD-yarns are adjacent to the said first pairs of MD-yarns, and the said third pairs of MD-yarns are adjacent to the said second pairs of MD-yarns. The first pairs of MD-yarns including first MD-yarns1 folded back and second MD-yarns2 in alignment and substantial abutment with said first MD-yarns to form first groups of loops; the second pairs of MD-yarns including third MD-yarns3 folded back and fourth MD-yarns4 in alignment and substantial abutment with said third MD-yarns to form a second group of loops; the third pairs of MD-yarns including fifth MD-yarns5 folded back and sixth MD-yarns6 in alignment and substantial abutment with said fifth MD-yarns5; holding the last CD-yarns forming the end of the fabric. The said loops being located at each end of the fabric body and cooperating with corresponding loops located at an adjacent opposed end of an adjacent fabric body to receive a retaining member and thereby form a seam which makes the fabric endless. And wherein the said loops are at identical length to each other over the whole fabric width.

Embodiment 1

A papermaking fabric comprising a woven fabric body having opposing ends, said fabric body having a system of MD-yarns interwoven with a system of CD yarns; wherein the fabric has a single layer weave construction; wherein the said MD-yarns comprising first pairs of MD-yarns, second pairs of MD-yarns and third pairs of MD-yarns; wherein said first pairs, second pairs and third pairs MD-yarns are interwoven with said CD yarns in a repeat weave pattern; wherein each of said first and second pairs form seaming loops at widthwise edges of said fabric. The said first pairs, second pairs and third pairs MD-yarns are arranged in a sequence, such that the said second pairs of MD-yarns are adjacent to the said first pairs of MD-yarns, and the said third pairs of MD-yarns are adjacent to the said second pairs of MD-yarns. The first pairs of MD-yarns including first MD-yarns1 folded back and second MD-yarns2 in alignment and substantial abutment with said first MD-yarns to form a first group of loops; the second pairs of MD-yarns including third MD-yarns3 that are folded back, and fourth MD-yarns4 in alignment and substantial abutment with said third MD-yarns to form a second group of loops; the third pairs of MD-yarns including fifth MD-yarns5 folded back and sixth MD-yarns6 in alignment and substantial abutment with said fifth MD-yarns5; holding the last CD-yarns forming the end of the fabric. The said loops being located at each end of the fabric body and cooperating with corresponding loops located at an adjacent opposed end of an adjacent fabric body to receive a retaining member and thereby form a seam which makes the fabric endless. And wherein the said loops are at identical length to each other over the whole fabric width. The MD-yarns are made of PET. The said wrap yarns having a rectangular cross section and the size of the said MD-yarns is 0.25 mm×0.55 mm.

Embodiment 2

A papermaking fabric comprising a woven fabric body having opposing ends, said fabric body having a system of MD-yarns interwoven with a system of CD yarns; wherein the fabric has a single layer weave construction; wherein the said MD-yarns comprising first pairs of MD-yarns, second pairs of MD-yarns and third pairs of MD-yarns; wherein said first pairs, second pairs and third pairs MD-yarns are interwoven with said CD yarns in a repeat weave pattern; wherein each of said first and second pairs form seaming loops at widthwise edges of said fabric. The said first pairs, second pairs and third pairs MD-yarns are arranged in a sequence, such that the said second pairs of MD-yarns are adjacent to the said first pairs of MD-yarns, and the said third pairs of MD-yarns are adjacent to the said second pairs of MD-yarns. The first pairs of MD-yarns including first MD-yarns1 folded back and second MD-yarns2 in alignment and substantial abutment with said first MD-yarns to form a first group of loops; the second pairs of MD-yarns including third MD-yarns3 folded back and fourth MD-yarns4 in alignment and substantial abutment with said third MD-yarns to form a second group of loops; the third pairs of MD-yarns including fifth MD-yarns5 folded back and sixth MD-yarns6 in alignment and substantial abutment with said fifth MD-yarns5; holding the last CD-yarns forming the end of the fabric. The said loops being located at each end of the fabric body and cooperating with corresponding loops located at an adjacent opposed end of an adjacent fabric body to receive a retaining member and thereby form a seam which makes the fabric endless. And wherein the said loops are at identical length to each other over the whole fabric width. The MD-yarns are made of PCTA. The said wrap yarns having a rectangular cross section and the size of the said MD-yarns is 0.45 mm×0.75 mm.

Embodiment 3

A papermaking fabric comprising a woven fabric body having opposing ends, said fabric body having a system of MD-yarns interwoven with a system of CD yarns; wherein the fabric has a single layer weave construction; wherein the said MD-yarns comprising first pairs of MD-yarns, second pairs of MD-yarns and third pairs of MD-yarns; wherein said first pairs, second pairs and third pairs MD-yarns are interwoven with said CD yarns in a repeat weave pattern; wherein each of said first and second pairs form seaming loops at widthwise edges of said fabric. The said first pairs, second pairs and third pairs MD-yarns are arranged in a sequence, such that the said second pairs of MD-yarns are adjacent to the said first pairs of MD-yarns, and the said third pairs of MD-yarns are adjacent to the said second pairs of MD-yarns. The first pairs of MD-yarns including first MD-yarns1 folded back and second MD-yarns2 in alignment and substantial abutment with said first MD-yarns to form a first group of loops; the second pairs of MD-yarns including third MD-yarns3 that are folded back, and fourth MD-yarns4 in alignment and substantial abutment with said third MD-yarns to form a second group of loops; the third pairs of MD-yarns including fifth MD-yarns5 folded back and sixth MD-yarns6 in alignment and substantial abutment with said fifth MD-yarns5; holding the last CD-yarns forming the end of the fabric. The said loops being located at each end of the fabric body and cooperating with corresponding loops located at an adjacent opposed end of an adjacent fabric body to receive a retaining member and thereby form a seam which makes the fabric endless. And wherein the said loops are at identical length to each other over the whole fabric width. The MD-yarns are made of PPS. The said wrap yarns having a rectangular cross section and the size of the said MD-yarns is 0.36×0.67 mm.

Embodiment 4

A papermaking fabric comprising a woven fabric body having opposing ends, said fabric body having a system of MD-yarns interwoven with a system of CD yarns; wherein the fabric has a single layer weave construction; wherein the said MD-yarns comprising first pairs of MD-yarns, second pairs of MD-yarns and third pairs of MD-yarns; wherein said first pairs, second pairs and third pairs MD-yarns are interwoven with said CD yarns in a repeat weave pattern; wherein each of said first and second pairs form seaming loops at widthwise edges of said fabric. The said first pairs, second pairs and third pairs MD-yarns are arranged in a sequence, such that the said second pairs of MD-yarns are adjacent to the said first pairs of MD-yarns, and the said third pairs of MD-yarns are adjacent to the said second pairs of MD-yarns. The first pairs of MD-yarns including first MD-yarns1 folded back and second MD-yarns2 in alignment and substantial abutment with said first MD-yarns to form a first group of loops; the second pairs of MD-yarns including third MD-yarns3 that are folded back, and fourth MD-yarns4 in alignment and substantial abutment with said third MD-yarns to form a second group of loops; the third pairs of MD-yarns including fifth MD-yarns5 folded back and sixth MD-yarns6 in alignment and substantial abutment with said fifth MD-yarns5; holding the last CD-yarns forming the end of the fabric. The said loops being located at each end of the fabric body and cooperating with corresponding loops located at an adjacent opposed end of an adjacent fabric body to receive a retaining member and thereby form a seam which makes the fabric endless. And wherein the said loops are at identical length to each other over the whole fabric width. The MD-yarns are made of 30% PPS and 70% PCTA. The said wrap yarns having a round cross section and the dimension of the said round MD-yarns is 0.50 mm.

Embodiment 5

A papermaking fabric comprising a woven fabric body having opposing ends, said fabric body having a system of MD-yarns interwoven with a system of CD yarns; wherein the fabric has a single layer weave construction; wherein the said MD-yarns comprising first pairs of MD-yarns, second pairs of MD-yarns and third pairs of MD-yarns; wherein said first pairs, second pairs and third pairs MD-yarns are interwoven with said CD yarns in a repeat weave pattern; wherein each of said first and second pairs form seaming loops at widthwise edges of said fabric. The said first pairs, second pairs and third pairs MD-yarns are arranged in a sequence, such that the said second pairs of MD-yarns are adjacent to the said first pairs of MD-yarns, and the said third pairs of MD-yarns are adjacent to the said second pairs of MD-yarns. The first pairs of MD-yarns including first MD-yarns1 folded back and second MD-yarns2 in alignment and substantial abutment with said first MD-yarns to form a first group of loops; the second pairs of MD-yarns including third MD-yarns3 that are folded back, and fourth MD-yarns4 in alignment and substantial abutment with said third MD-yarns to form a second group of loops; the third pairs of MD-yarns including fifth MD-yarns5 folded back and sixth MD-yarns6 in alignment and substantial abutment with said fifth MD-yarns5; holding the last CD-yarns forming the end of the fabric. The said loops being located at each end of the fabric body and cooperating with corresponding loops located at an adjacent opposed end of an adjacent fabric body to receive a retaining member and thereby form a seam which makes the fabric endless. And wherein the said loops are at identical length to each other over the whole fabric width. The MD-yarns are made of 40% PET and 60% PPS. The said wrap yarns having a round cross section and the dimension of the said round MD-yarns is 0.70 mm.

Embodiment 6

A papermaking fabric comprising a woven fabric body having opposing ends, said fabric body having a system of MD-yarns interwoven with a system of CD yarns; wherein the fabric has a single layer weave construction; wherein the said MD-yarns comprising first pairs of MD-yarns, second pairs of MD-yarns and third pairs of MD-yarns; wherein said first pairs, second pairs and third pairs MD-yarns are interwoven with said CD yarns in a repeat weave pattern; wherein each of said first and second pairs form seaming loops at widthwise edges of said fabric. The said first pairs, second pairs and third pairs MD-yarns are arranged in a sequence, such that the said second pairs of MD-yarns are adjacent to the said first pairs of MD-yarns, and the said third pairs of MD-yarns are adjacent to the said second pairs of MD-yarns. The first pairs of MD-yarns including first MD-yarns1 folded back and second MD-yarns2 in alignment and substantial abutment with said first MD-yarns to form a first group of loops; the second pairs of MD-yarns including third MD-yarns3 folded back and fourth MD-yarns4 in alignment and substantial abutment with said third MD-yarns to form a second group of loops; the third pairs of MD-yarns including fifth MD-yarns5 folded back and sixth MD-yarns6 in alignment and substantial abutment with said fifth MD-yarns5; holding the last CD-yarns forming the end of the fabric. The said loops being located at each end of the fabric body and cooperating with corresponding loops located at an adjacent opposed end of an adjacent fabric body to receive a retaining member and thereby form a seam which makes the fabric endless. And wherein the said loops are at identical length to each other over the whole fabric width. The MD-yarns are made of 70% PPS and 30% PCTA. The said wrap yarns having a round cross section and the dimension of the said round MD-yarns is 0.60 mm.

Based on the above explanation, the various features of the other embodiments of this invention would be readily understood by a person skilled in the art. Therefore, no further explanation is provided herein.

It also should be noted that the yarn diameters of the paper side MD-yarns and the wear side MD-yarns can be varied, and preferably are different from each other. The most preferred relationships of the diameters of the paper side MD-yarns and the wear side MD-yarns is disclosed in the Summary of the Invention and will not be repeated herein for purposes of brevity. Suffice it to state that the specified yarn diameters and their disclosed relationship to each other can be employed in all of the various disclosed embodiments of this invention.

Finally, although reference has been made to the yarns of the various disclosed embodiments having diameters, it is to be understood that the cross sectional shape of any or all of the yarns used in any of the embodiments may be of non-circular profile e.g., ovate, rectangular, square, bi-nodal, etc.

The invention claimed is:

1. A papermaking fabric, comprising:

a woven fabric body having opposing ends defining widthwise edges;

said fabric body having a system of MD-yarns interwoven with a system of CD yarns in a single layer weave construction;

said MD-yarns including first pairs of MD-yarns, second pairs of MD-yarns, and third pairs of MD-yarns;

said first pairs, second pairs, and third pairs of MD-yarns being interwoven with said CD yarns in a repeat weave pattern; and each of said first and second pairs of MD-yarns forming seaming loops at at least one of said widthwise edges of said fabric, said loops having an identical length to each other over an entire fabric width.

2. The papermaking fabric according to claim 1, wherein the said first pairs, second pairs and third pairs of MD-yarns are arranged in sequence, said second pairs of MD-yarns are adjacent said first pairs of MD-yarns, and said third pairs of MD-yarns are adjacent said second pairs of MD-yarns.

3. The papermaking fabric according to claim 1, wherein:

the first pairs of MD-yarns include said first MD-yarns folded back and second MD-yarns in alignment and substantial abutment with said first MD-yarns to form a first group of loops;

the second pairs of MD-yarns include third MD-yarns folded back and fourth MD-yarns in alignment and substantial abutment with said third MD-yarns to form a second group of loops;

the third pairs of MD-yarns include fifth MD-yarns folded back and sixth MD-yarns in alignment and substantial abutment with said fifth MD-yarns holding the last CD-yarns forming the end of the fabric.

4. The papermaking fabric according to claim 1, wherein said loops are formed at each end of said fabric body and cooperate with corresponding loops located at an adjacent opposed end of an adjacent fabric body to receive a retaining member and thereby form a seam and making the fabric endless.

5. The papermaking fabric according to claim 1, wherein said MD-yarns are of a polymeric material.

6. The papermaking fabric according to claim 5, wherein said polymeric material is selected from the group consisting of PET, PCTA, PPS, each alone or in combination.

7. The papermaking fabric according to claim 1, wherein the said warp yarns have a rectangular cross section.

8. The papermaking fabric according to claim 7, wherein said MD-yarns have a size dimension within a range of between 0.25 mm×0.55 mm and 0.45 mm×0.75 mm.

9. The papermaking fabric according to claim 8, wherein a size of said MD-yarns is 0.36×0.67 mm.

10. The papermaking fabric according to claim 1, wherein said warp yarns have a round cross section.

11. The papermaking fabric according to claim 10, wherein said round MD-yarns have diameter of between 0.50 mm and 0.70 mm.

12. The papermaking fabric according to claim 11, wherein the diameter of said round MD-yarns is 0.60 mm.

13. A papermaking fabric, comprising:

a woven fabric body having opposing ends, said fabric body having a system of MD-yarns interwoven with a system of CD yarns;

said fabric having a single layer weave construction; and a seam with seam loops, said loops having an identical length to each other over an entire fabric width, and wherein a percentage of MD-yarn ends formed as the seam loops is 33.3%.

14. The papermaking fabric according to claim 13, wherein said MD-yarns are made of a polymeric material.

15. The papermaking fabric according to claim 14, wherein said polymeric material is selected from the group consisting of PET, PCTA, PPS, each alone or in combination.

16. The papermaking fabric according to claim 13, wherein the said warp yarns having a rectangular cross section.

17. The papermaking fabric according to claim 16, wherein said MD-yarns have a size dimension within a range of between 0.25 mm×0.55 mm and 0.45 mm×0.75 mm.

18. The papermaking fabric according to claim 17, wherein a size of said MD-yarns is 0.36×0.67 mm.

19. The papermaking fabric according to claim 13, wherein said warp yarns have a round cross section.

20. The papermaking fabric according to claim 19, wherein said round MD-yarns have diameter of between 0.50 mm and 0.70 mm.

21. The papermaking fabric according to claim 20, wherein the diameter of said round MD-yarns is 0.60 mm.

* * * * *